United States Patent [19]

Blackman

[11] Patent Number: 4,782,943

[45] Date of Patent: Nov. 8, 1988

[54] BASKET-LIKE CARRIER FOR CUPS AND THE LIKE AND BLANK FOR FORMING THE SAME

[75] Inventor: Stephen M. Blackman, Westmont, Ill.

[73] Assignee: Federal Paper Board Co., Inc., Montvale, N.J.

[21] Appl. No.: 940,617

[22] Filed: Dec. 11, 1986

[51] Int. Cl.[4] ..... B65D 5/46

[52] U.S. Cl. ..... 206/175; 229/52 BC; 229/DIG. 9

[58] Field of Search ..... 229/41 B, 52 BC, 28 BC, 229/DIG. 9; 206/175, 180, 188, 143, 147, 191, 189, 193, 186, 163

[56] References Cited

U.S. PATENT DOCUMENTS

| | | | |
|---|---|---|---|
| 2,273,266 | 2/1942 | Himes | 229/28 BC X |
| 2,389,318 | 11/1945 | Lebold | 229/DIG. 9 |
| 2,476,181 | 7/1949 | Crane et al. | 229/52 BC X |
| 2,821,328 | 1/1958 | Ramsay | 229/28 BC X |
| 3,721,368 | 3/1973 | Arneson | 229/DIG. 9 |
| 4,378,880 | 4/1983 | Summers | 229/41 B X |
| 4,509,640 | 4/1985 | Joyce | 206/163 X |
| 4,610,349 | 9/1986 | Schwartz et al. | 229/41 B X |

FOREIGN PATENT DOCUMENTS

| | | | |
|---|---|---|---|
| 2010781 | 7/1979 | United Kingdom | 229/DIG. 9 |

*Primary Examiner*—Jimmy G. Foster

*Attorney, Agent, or Firm*—Charles E. Brown; Charles A. Brown

[57] ABSTRACT

A carrier for cups. The carrier is formed from a flat blank to have a flat folded state from which it may be readily erected by pressing together on opposite ends. In addition to a base having a bottom, the carrier has an upstanding combined separator and handle. As a result, the upper configuration of the blank is one wherein like blanks in inverted relation and longitudinally shifted may be nested. The nesting may either be a positive nest where there is waste at one end of each of two blanks or two adjacent blanks may be longitudinally and transversely shifted relative to one another to provide a major nesting while having a minimum amount of waste material between two opposed blanks. With this arrangement, the blanks may be formed endlessly in end-to-end relation along an elongated web.

15 Claims, 3 Drawing Sheets

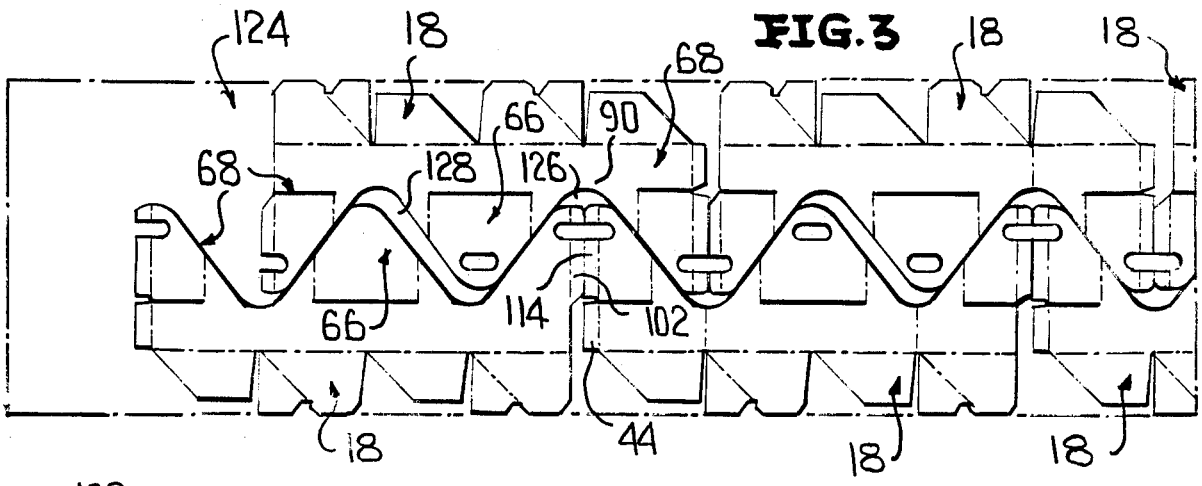
FIG.3
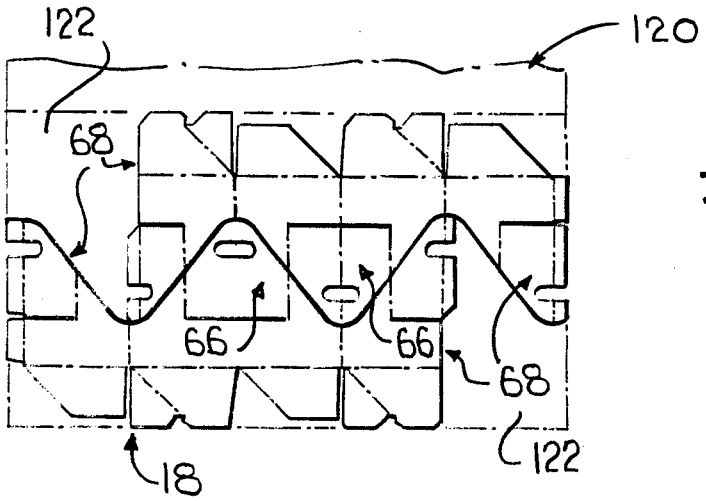
FIG.2
FIG.1
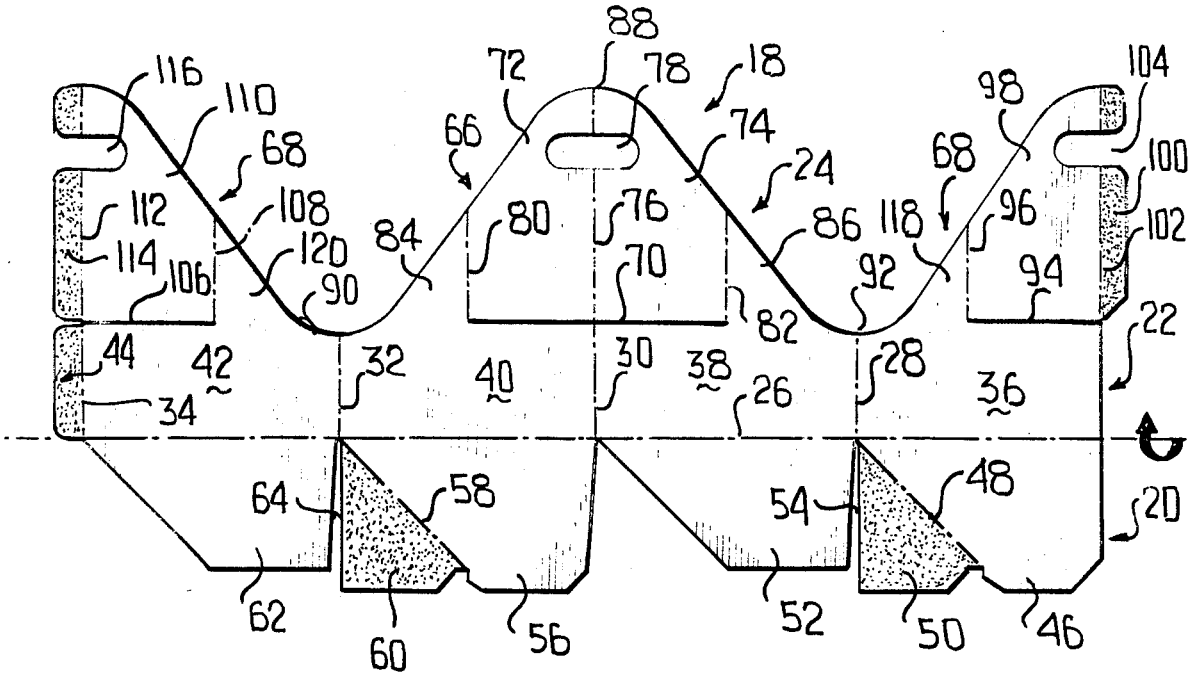

FIG. 4
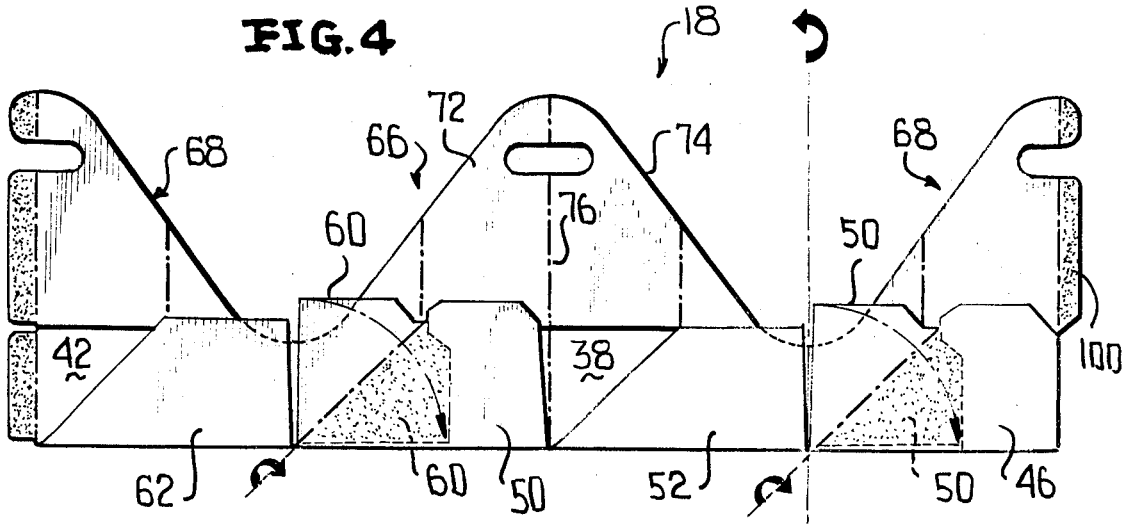
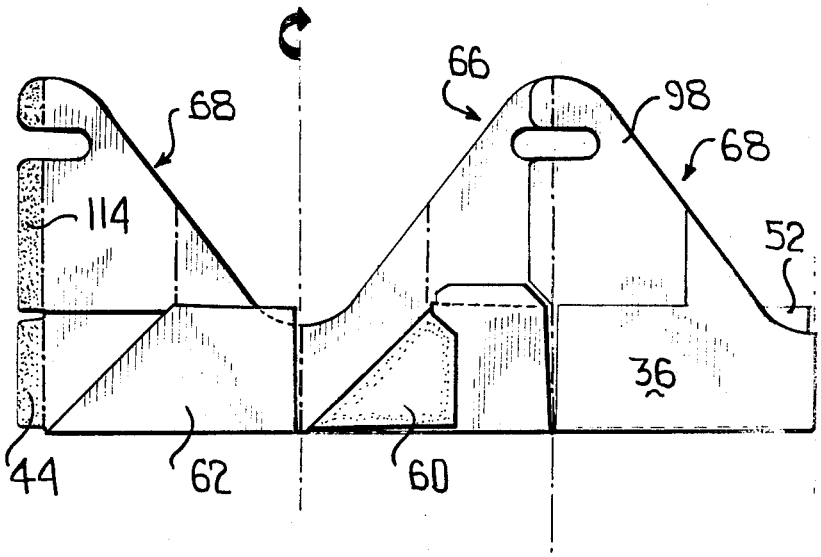
FIG. 5
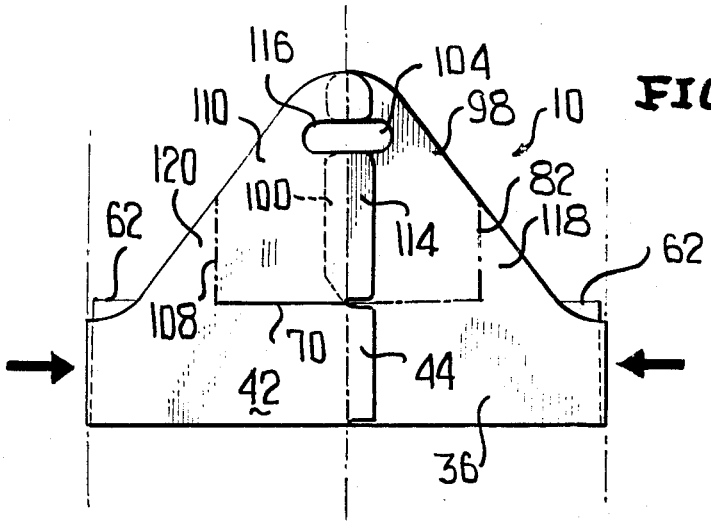
FIG. 6

FIG.7
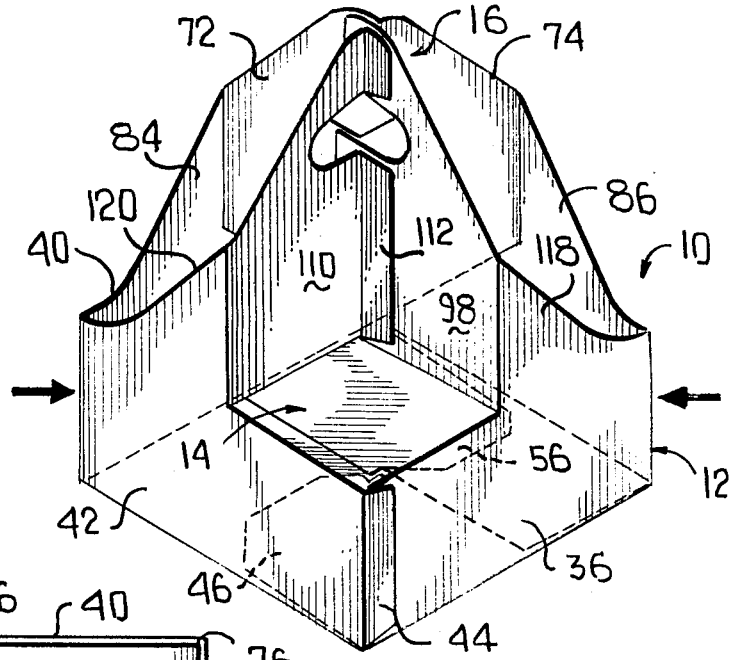
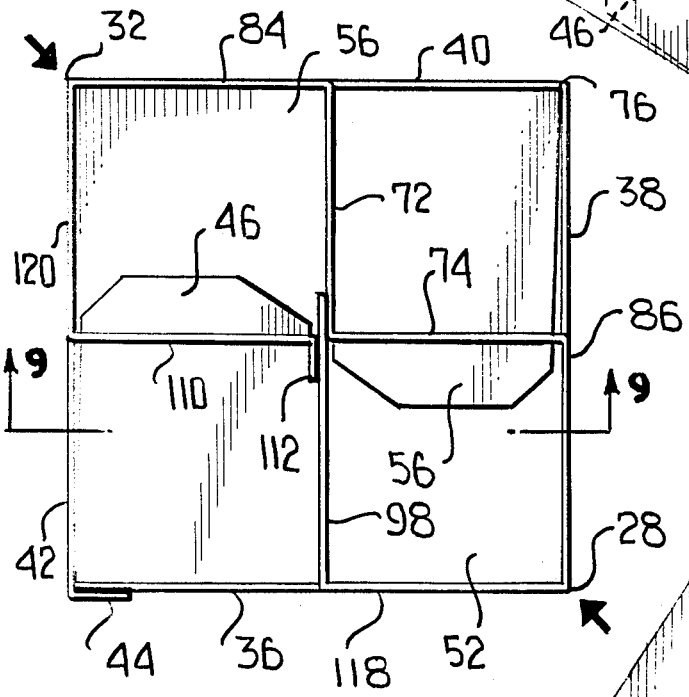
FIG.8
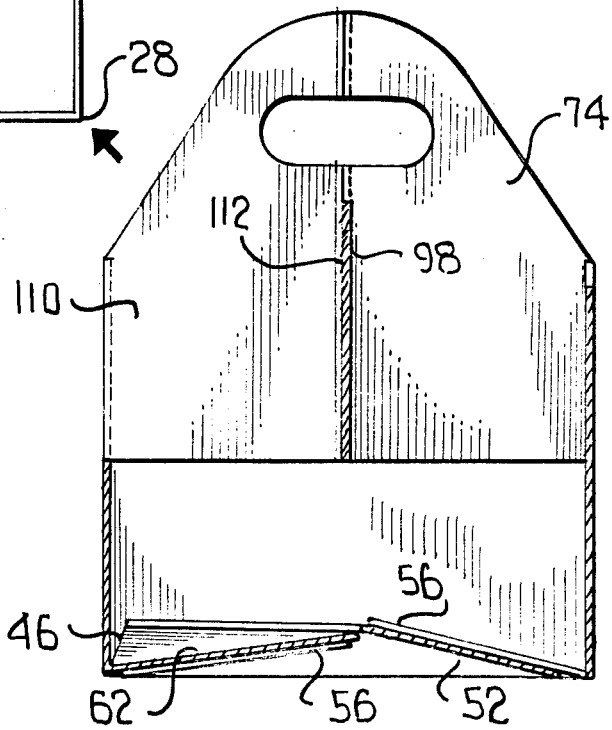
FIG.9

BASKET-LIKE CARRIER FOR CUPS AND THE LIKE AND BLANK FOR FORMING THE SAME

This invention relates in general to new and useful improvements in basket-like carriers for cups and more particularly to a carrier which is formed of paperboard utilizing a minimum of material.

The carrier of this invention is of the type generally disclosed in the patent to Michael F. Joyce, U.S. Pat. No. 4,509,640. However, the upper portion of the carrier is so configurated wherein two adjacent central upper panel members have a combined configuration which is the reverse of the configuration of the space between one upper central panel member and an adjacent end panel member. Thus when the blanks are being formed from a web, at least a certain degree of internesting of two adjacent blanks is possible permitting the blank for a carrier to be formed utilizing less paperboard than in the past.

With the above and other objects in view that will hereinafter appear, the nature of the invention will be more clearly understood by reference to the following detailed description, the appended claims, and the several views illustrated in the accompanying drawings.

FIG. 1 is a plan view of a blank which may be suitably folded and glued together to form in its folded state a carrier in accordance with this invention.

FIG. 2 is a plan view on a reduced scale showing the manner in which two of the blanks of FIG. 1 may be internested with respect to one another thereby permitting the blanks to be formed from a web with a minimum of material.

FIG. 3 is another plan view on a reduced scale of a web showing how a number of the blanks of FIG. 1 may be formed from a web utilizing a minimum of material by longitudinally and transversely shifting adjacent blanks so that the waste material of the web is primarily in the form of an elongated narrow strip between two upper central portions of two opposed adjacent blanks.

FIG. 4 is a plan view of the blank of FIG. 1 after the bottom forming panels thereof have been folded upwardly into generally overlying relation with respect to the base forming portion of the blank.

FIG. 5 is a plan view similar to FIG. 4 showing the right end portion of the partially folded blank further folded into overlying relation with respect to the right central portion of the blank.

FIG. 6 is a plan view of the completely folded blank wherein portions thereof have been bonded together to define a folded or collapsed carrier.

FIG. 7 is a top perspective view of an erected carrier formed from the folded carrier of FIG. 6.

FIG. 8 is a top plan view of the carrier of FIG. 7 and shows generally the manner in which it is erected from its folded form of FIG. 6 by pressing in on the opposite corners.

FIG. 9 is a vertical sectional view taken generally along the line 9—9 of FIG. 8 and shows the specific cross section of the carrier including the bottom thereof.

Referring now to the drawings in detail, it will be seen that there is illustrated in FIG. 7 a basket-like carrier formed in accordance with this invention, the carrier being generally identified by the numeral 10. The carrier 10 includes a generally square base 12 having a bottom 14. A combined separator and handle structure 16 extends upwardly from the base 12.

The carrier 10 is formed from a blank which is illustrated in FIG. 1, the blank being generally identified by the numeral 18. The blank, like the carrier, is divided into three portions including a lower bottom forming portion 20, an intermediate base forming portion 22 and an upper combined separator and handle forming portion 24. The bottom forming portion 20 is separated from the base forming portion 22 by a fold line 26. A plurality of fold lines 28, 30, 32 and 34 extend normal to the fold line 26 and set out base panels 36, 38, 40 and 42 and a glue flap 44. A first bottom panel 46 is connected to the base panel 36 along the fold line 26. The bottom forming panel 46 has attached along one edge thereof by way of a fold line 48 a bottom forming glue flap 50.

A first central bottom forming panel 52 is connected to the base panel 38 along the fold line 26 and is separated from the flap 50 by a cutout 54.

A second central bottom forming panel 56 is connected to the base forming panel 40 along the fold line 26 and has the same configuration as the bottom forming panel 46. The panel 56 carries along one edge thereof by way of a fold line 58 a triangular glue flap 60. It will be seen that the glue flap 60 corresponds to the glue flap 50.

Finally, there is a further end bottom forming panel 62 which is connected to the base forming panel 42 along the fold line 26. The panel 62 is separated from the flap 60 by a cutout 64 and has the same configuration as the panel 52.

The upper portion 24 of the blank 18 includes a double panel central portion, generally identified by the numeral 66 and single panel end portions 68 which are identical except for being of left and right hand configurations.

The central portion 66 is provided with a cut line 70 disposed parallel to the fold line 26 and defining bottom edges of two interconnected central panel members 72, 74. The panel members 72, 74 are hingedly connected together along a fold line 76 which is an extension of the fold line 30. The panel members 72, 74 are provided with a cutout 78 which extends across the fold line 76 and in effect defines two U-shaped cutouts.

The central panel members 72, 74 are further defined by fold lines 80, 82 which extend from the ends of the cut line 70 parallel to the fold line 76. This leaves as parts of the central portion 66 triangular support panels 84, 86 which project upwardly from the base panels 40, 38, respectively.

At this time it is pointed out that the extreme upper part of the portion 66 is rounded as at 88. The upper edge of the blank 18 is also rounded as at 90 and 92 centered on the fold lines 32, 28 in upwardly opening direction. It is to be noted that the rounded portions 90, 92 extend below the cut line 70.

The upper edge of the base panel 36 is defined by a cut line 94 which extends inwardly from the right edge of the blank 18 and terminates in a fold line 96 which is disposed parallel to the fold line 28. The cut line 94 and the fold line 96 define an end panel member 98 which carries along the free edge thereof a glue flap 100 which is connected to the panel member 98 along a fold line 102.

The end panel member 98 is provided with a cutout 104 which corresponds to one half of the cutout 78. This cutout 104 also extends through the glue flap 100.

The left hand end portion 68 is provided with a cut line 106 which corresponds to the cut line 94 and extends to the left from the left edge of the blank 18. A fold line 108 extends upwardly from the inner end of the cut line 106. The cut line 106 together with the fold line 108 define as part of the edge portion 68 an edge panel member 110. The edge panel member 110 has connected thereto along a fold line 112, a glue flap 114. The glue flap 114 is interrupted by a cutout 116 which generally corresponds to the cutout 104.

In the formation of the end panel member 98, there is also formed a triangular support panel 118 which is integrally connected to the base panel 36. In a like manner, in the formation of the panel member 110, there is formed a triangular support panel 120 which is integrally connected to the base panel 42.

In the formation of the folded carton 10, the lower portion 20 of the blank 18 is folded along the fold line 26 so as to overlie the intermediate base forming portion 22 as is shown in FIGS. 1 and 4. Then the glue flaps 50, 60 are reversely folded into overlying relation with respect to the bottom panels 46, 56 with the adhesive side facing upwardly.

Next, the right end portion 68 is folded along the fold line 28 to overlie the right part of the central portion 66 as is shown in FIG. 5. At this time the glue flap 50 is bonded to the bottom panel 52 and the interrupted glue flap 100 is bonded to the panel member 72 just beyond the fold line 76.

Finally, as is shown in FIG. 6, the left end portion 68 is folded along the fold line 32 into overlying relation with respect to the left half of the central portion 66. At this time the glue flap 60 bonds to the bottom panel 62 and the interrupted glue flap 114 bonds to the panel member 98. At the same time, the glue flap 44 is brought into overlying relation and is bonded to base panel 36.

The folded carton 10 is now ready for shipment and storage. It is further ready for further erection.

It will be readily apparent from the foregoing that the carrier 10 is of a rigid construction, simple to form and light in weight while utilizing a minimum of paperboard. However, the carrier configuration is one wherein the carrier blanks 18 may be formed of a web with a minimum of waste.

It will be apparent from FIGS. 7 and 8 that the base 12 is square cut at two opposite corners between the panel members 72 and 74 on the one hand, and panel members 98 and 110 on the other hand.

With reference to FIG. 2, it will be seen that when blanks 18 are formed from a web 120 having a width equal to the length of a blank 18 plus the dimension of the base panel 42 and the glue flap 44 longitudinally of the blank, two blanks, in oppositely facing directions, may be fully nested but a single panel width out of phase. Thus there is no loss between the two internested blanks. On the other hand, at opposite corners of the web portion 120 from which the two blanks 18 are formed, there will be waste material 122. The waste material 122 will be identical.

On the other hand, it is possible to form the blanks 18 on a continuous basis out of a web 124 which is a width slightly greater than the combined nested heights of two blanks 18 as shown in FIG. 2. This arrangement is shown in FIG. 1. However, in order to provide clearance for the glue flaps 100, 44 and 114 at opposed ends of two adjacent blanks 18, it is necessary that the spacing between a central portion 66 and an adjacent end portion 68 of an opposing inverted blank 18 be effectively increased by separating the blanks transversely of the web 124 as is clearly shown in FIG. 3. The nest result is that the blanks 18 may be formed in end-to-end relation longitudinally of the web 124 with the waste material being held to a minimum. It will be seen that there will be waste as at 126 in the pocket defined by the curve line 90. There will also be waste between the two adjacent central portions as at 128.

It will be readily apparent from both FIG. 2 and FIG. 3 that by so conforming the blanks 18 so that a certain degree of nesting is obtainable, the blanks 18 may be formed from webs with a minimum waste of paperboard. This is due to the configuration of the upper part of the carrier 10 which permits a certain degree of nesting between two adjacent blanks disposed in opposed inverted relation.

Although only a preferred embodiment of the invention has been specifically illustrated and described herein, and only two arrangements of blanks on a web have been specifically illustrated, it is to be understood that minor variations may be made in the structure of the carrier and the placement of carrier blanks on a web without departing from the spirit and scope of the invention as defined by the appended claims.

I claim:

1. A basket-like carrier comprising a base having a bottom, said base being defined by side walls, and combined separator and handle structure extending upwardly from central portions of said side walls, said combined separator and handle structure including a panel member extending from each of said side walls and intersecting like panel members in a centrally located vertical line, each of said panel members having an upper portion forming part of said handle structure, said handle structure being primarily of a single thickness with each of said panel members having a major portion thereof free of others of said panel members, two adjacent ones of said panel members being joined along a fold extending along said centrally located vertical line and together having a rounded tip and partially rounded base portions.

2. A carrier according to claim 1 wherein an edge of one of said two adjacent panel members and an edge of a next adjacent further one of said panel members define a configuration which is identical to the configuration of said two adjacent panel members but inverted.

3. A carrier according to claim 2 wherein said base at two opposite corners is square cut between panel members between which said corners are located, and said base at two other opposite corners slopes upwardly in diverging relation towards adjacent ones of said panel members for defining support panels for said adjacent panel members.

4. A carrier according to claim 3 wherein each of said two other opposite corners is defined by downwardly converging curving panel member edges.

5. A carrier according to claim 1 wherein said base at two opposite corners is square cut between panel members between which web corners are located, and said base at two other opposite corners slopes upwardly in diverging relation towards adjacent ones of said panel members for defining support panels for said adjacent panel members.

6. A carrier according to claim 5 wherein each of said two other opposite corners is defined by downwardly converging curving panel member edges.

7. A carrier according to claim 1 wherein each of said panel members has formed therein a cutout opening towards said vertical line, all of said cutouts opening into one another.

8. A blank for a basket-like carrier, said blank comprising a lower portion, an intermediate portion and an upper portion, said lower portion being in the form of a plurality of bottom forming panels and flaps, said intermediate portion being in the form of a plurality of body forming panels, and said upper portion being in the form of a plurality of panel members for defining a combined separator and handle structure with said handle structure being primarily of a single thickness, said panel members including two central panel members joined together and spaced end panel members, said end panel members carrying flaps forming sole means for securing said panel members together in said handle structure, the configuration of the space between each end panel member and said central panel members being of a configuration corresponding to the configuration of said joined together central panel members.

9. A blank assembly comprising two blanks formed from a web in opposed longitudinally offset nested relation, each of said blanks comprising a lower portion, an intermediate portion and an upper portion, said lower portion being in the form of a plurality of bottom forming panels and flaps, said intermediate portion being in the form of a plurality of body forming panels, and said upper portion being in the form of a plurality of panel members for defining a combined separator and handle structure with said handle structure being primarily of a single thickness, said panel members including two central panel members joined together and spaced end panel members, said end panel members carrying flaps forming sole means for securing said panel members together in said handle structure, the configuration of the space between each end panel member and said central panel members being of a configuration corresponding to the configuration of said joined together central panel members.

10. A blank assembly according to claim 9 wherein said two central panel members of each blank are in full nested relation with the other of said blanks.

11. A blank assembly according to claim 9 wherein said two central panel members of each blank are in full nested relation with the other of said blanks, and a portion of said web at one end of each blank is discarded.

12. A blank assembly according to claim 9 wherein said two central panel members of each blank are in full nested relation with the other of said blanks, and a portion of said web at one end of each blank is discarded, said discarded web portions being in diametrically arranged relation.

13. A blank assembly according to claim 9 wherein said blanks are shifted longitudinally and transversely on said web.

14. A blank assembly comprising two blanks formed from a web in opposed longitudinally offset nested relation, each of said blanks comprising a lower portion, an intermediate portion and an upper portion, said lower portion being in the form of a plurality of bottom forming panels and flaps, said intermediate portion being in the form of a plurality of body forming panels, and said upper portion being in the form of a plurality of panel members for defining a combined separator and handle structure, said panel members including two central panel members joined together and spaced end panel members, the configuration of the space between each end panel member and said central panel members being of a configuration corresponding to the configuration of said joined together central panel members, said blanks being shifted longitudinally and transversely on said web with end panel portions of two longitudinally adjacent blanks being nested between a central panel portion and an end panel portion of a transverse adjacent blank.

15. A blank assembly according to claim 14 wherein web waste from between two transversely adjacent blanks is primarily between two opposed but spaced central panel members.

* * * * *